United States Patent [19]

Rothman

[11] 3,970,005

[45] July 20, 1976

[54] MASS FOCUS EXPLOSIVE LAYERED BOMBLET

[75] Inventor: Mathew Rothman, Seminole County, Fla.

[73] Assignee: The United States of America as represented by the Secretary of the Air Force, Washington, D.C.

[22] Filed: Jan. 25, 1969

[21] Appl. No.: 803,521

[52] U.S. Cl. ..... 102/67

[51] Int. Cl.[2] ..... F42B 13/18; F42B 13/48

[58] Field of Search ..... 102/67, 68, 58, 56, 102/57, 64

[56] References Cited

UNITED STATES PATENTS

| | | | |
|---|---|---|---|
| 2,933,799 | 4/1960 | Semon | 102/67 |
| 2,972,949 | 2/1961 | MacLeod | 102/67 |
| 3,100,445 | 8/1963 | Poulter | 102/56 |
| 3,447,463 | 6/1969 | Lavine | 102/67 |

*Primary Examiner*—Charles T. Jordan

*Attorney, Agent, or Firm*—Joseph E. Rusz; Arsen Tashjian

[57] ABSTRACT

A fragmentation bomblet, packaged as a close-ended steel right circular cylinder, having: an explosive train which is initiated along the periphery of the inner surface of the cylinder wall; a centrally located main charge; and a plurality of fragmentation-type plates parallel to each other, with an explosive layer between adjacent plates, and with the lowest of the plates forming the bottom of the cylinder.

3 Claims, 2 Drawing Figures

INVENTOR.
MATHEW ROTHMAN
BY Harry A. Herbert, Jr. and Arsen Tashjian
ATTORNEYS

LEGEND:
× EXPLOSIVE/FRAGMENT LAYERED
O NON EXPLOSIVE/FRAGMENT LAYERED

INVENTOR.
MATHEW ROTHMAN
BY
Arsen Tashjian
ATTORNEYS

MASS FOCUS EXPLOSIVE LAYERED BOMBLET

BACKGROUND OF THE INVENTION

This invention relates to a fragmentation bomblet, and more particularly to a fragmentation bomblet which utilizes peripheral explosive train initiation, multilayer explosive fragmentation, and the concept of mass focus.

Broadly speaking, fragmentation bombs, bomblets and the like are for use against personnel and light material targets. The destructive effect of this type of munition is obtain primarily through the scattering of fragments of the munition at high velocity. Therefore, the optimum design of this type of munition is one which will produce the greatest number of effective fragments (i.e., fragments of uniform, but effective size). As a result, a typical individual munition of this type comprises an especially designed case having body walls which are of uniform thickness, with said walls being scored, grooved, notched and otherwise weakened to promote fragmentation, and high explosives (to cause fragmentation) the weight of which is small when compared to the total weight of the individual munition.

More specifically, the present state-of-the-art is admittedly such that fragments of predetermined size, weight and number are obtainable; and, a preselected distribution pattern of scattering of the fragments is attainable. However, the present state-of-the-art is also such that maximum fragment velocities of only 6800 feet per second are achievable, although a maximum velocity of 8000–9000 feet per second would be far more desirable.

My invention significantly advances the state-of-the-art by fulfilling the current need for higher maximum velocity fragmentation; and thereby increases the impact force and the lethality of the fragments.

SUMMARY OF THE INVENTION

This invention relates to a fragmentation type bomblet which combines the mass focus concept, incorporates a multilayer explosive-fragmentation plate structure, and uses an explosive train which includes peripheral initiation.

Therefore, an object of this invention is to provide a novel fragmentation bomblet, and similar munition, which uses the mass focus concept phenomena.

Another object of this invention is to provide a fragmentation bomblet, and similar munition, which incorporates a multilayer explosive-fragmentation plate structure.

Still another object of this invention is to cause the explosion of the main charge of a fragmentation bomblet, and similar munition, by means of peripheral initiation.

A further object of this invention is to increase the maximum velocity of the fragments of a fragmentation bomblet, and similar munition.

A still further objcet of this invention is to increase the impact force of the fragments of a fragmentation bomblet, and similar munition.

Yet another object is to provide a novel fragmentation bomblet, and similar munition, of increased lethality.

These, and still other and related, objects of this invention will become readily apparent after a consideration of the description of the invention and reference to the drawing.

DESCRIPTION OF THE PREFERRED EMBODIMENT

Figure 1:
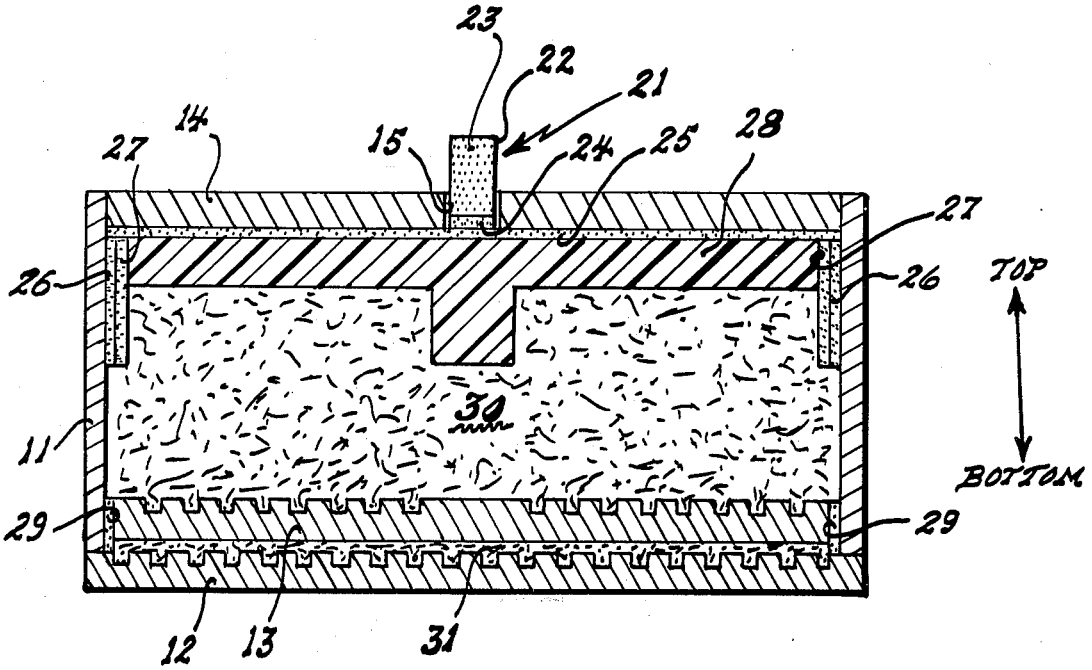
FIG. 1 is a simplified schematic view, in cross-section, of a preferred embodiment of the invention.

With reference to FIG. 1, the body or case 11 of the fragmentation bomblet shown therein is preferably, but not by way of limitation, an open-ended right circular cylinder and is made, preferably, of 0.125 inch thick mild steel.

At the bottom open-end of case 11, is fragment plate 12 which abuts, and is affixed by suitable means to, the bottom surface of case 11. Fragment plate 12 is notched or otherwise weakened on the top surface and is made, preferably, of 0.25 inch mild steel. The bottom surface of fragment plate 12 forms the bottom closed-end of case 11. Located wholly within case 11 and approximately 0.1 inch above, and parallel to, plate 12 is fragment plate 13, which similarly is of 0.25 inch thick mild steel, but with only a portion of the top surface being notched or otherwise weakened.

Top plate 14 is positioned wholly within the top open-end of case 11, abuts the inner surface thereof, and is affixed to case 11 by suitable means. Top surface of top plate 14 forms the top surface of the top closed-end of case 11. Top plate 14 is made, preferably, of 0.25 inch thick mild steel and has a centrally located opening 15.

Positioned within opening 15 of top plate 14, and abutting the internal surface of opening 15, is detonator assembly 21 comprising casing or housing 22 and detonator-type explosive 23. Detonator assembly 21 is affixed to top plate 14. Connected to detonator assembly 21, external of case 11 and top plate 14 and bottom fragment plate 12, are suitable means (not shown), such as an altitude-type fuze, for initiating the explosion of detonator-type explosive 23.

A small initiation disc 24 abuts the bottom external surface of casing 22 and the internal surface of opening 15 in top plate 14. Initiation disc 24 is of the same configuration as the bottom external surface of casing 22; and is of 0.042 inch thick "Detasheet", a flexible sheet-type high explosive, commercially available from E. I. DuPont DeNemours and Co., Inc. and which consists essentially of pentaerythrite tetranitrate (also known in the art as PETN) and an elastomeric binder.

The bottom surface of the small initiation disc 24 abuts the top surface of a much larger initiation disc 25 which in turn abuts the bottom surface of top plate 14 and the internal peripheral surface of case 11. Initiation disc 25 is of the same configuration as the bottom surface of top plate 14; and is also of 0.042 inch thick Detasheet.

An 0.042 inch thick strip 26 of Detasheet abuts the inner peripheral surface of case 11 and the bottom surface of initiation disc 25. Another 0.042 inch thick strip 27 of Detasheet abuts strip 26 and the bottom surface of initiation disc 25.

A buffer or spacer 28 of inert foam plastic material, such as "Styrofoam", approximately 0.375 inch thick abuts the bottom surface of initiation disc 25 and the surface of strip 27. A portion of the bottom surface of buffer 28 (i.e., that portion disposed in line with and below detonator assembly 23) extends downwardly.

A centrally located main charge 30 is disposed between the top surface of fragment plate 13 and the bottom surface of buffer 28 and abuts those components and, additionally, abuts strips 27 and 29. Main charge 30 is a high explosive, such as the one known in the art as "C-4", which consists essentially of 91% cyclotrimethelene trinitramine (i.e. RDX) and of 9% conventional binder material.

Disposed between the bottom surface of fragment plate 13 and the top surface of fragment plate 12 is a layer of high explosive 31, preferably C-4, which also abuts strip 29.

Also with reference to FIG. 1, applicant has reference, in describing the preferred embodiment, to a bomblet the diameter of which is approximately 5 inches and the height of which is approximately 2.5 inches.

Figure 2:
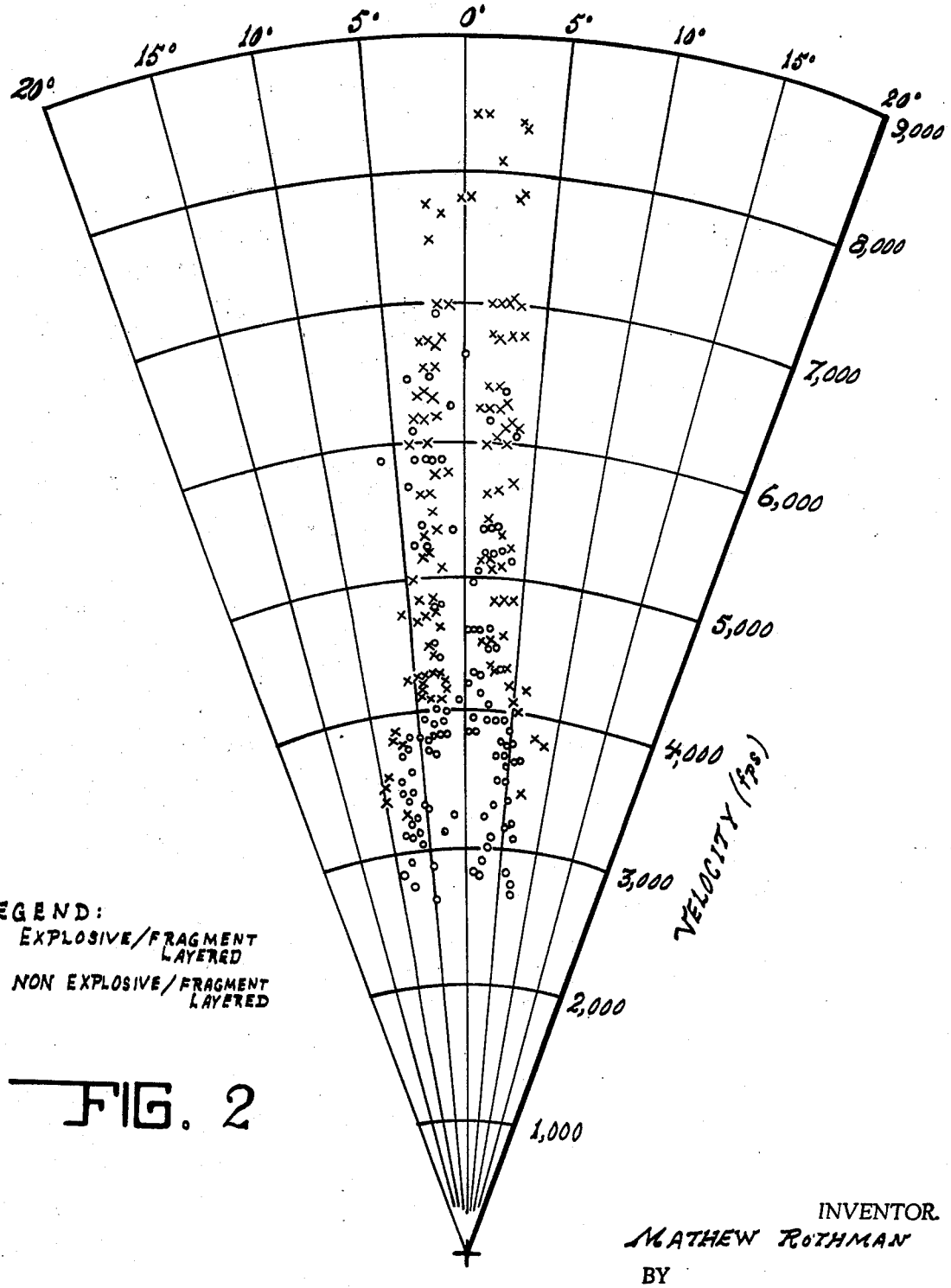
FIG. 2 is a chart showing the pattern of dispersion of the fragments from a conventional fragmentation bomblet and from a fragmentation bomblet incorporating my invention, which compares the dispersion of the fragments in angular deviation and in forward velocity from the point of explosion.

With reference to FIG. 2, there is shown, in chart form, a comparison of the scatter or dispersion pattern of the fragments from a conventional fragmentation bomblet and from my preferred embodiment of a fragmentation bomblet, as depicted in FIG. 1. One can readily see from an inspection of FIG. 2 that the fragments from my invention have traveled with a significantly greater forward velocity than the fragments from a conventional bomblet, and have done so without increase in angular deviation.

MODE OF OPERATION OF THE PREFERRED EMBODIMENT

Essentially, my invention and the preferred embodiment thereof as depicted in FIG. 1, utilizes peripheral explosive train initiation, multilayer explosive fragmentation, and the concept of mass focus to result in symmetrical, but enhanced, detonation and fragments having a maximum velocity significantly greater than fragments of a conventional fragmentation bomblet.

More specifically, after initiation of detonator-type explosive 23 in casing 22 of detonator assembly 21, by suitable means (not shown), explosive 23 detonates, resulting sequentially in initiation and explosion of small initiation disc 24 initiation disc 25 and strips 26 and 27. This explosive train action results in the simultaneous peripheral initiation of centrally located main charge 30. It is to be noted that buffer 28 prevents transfer of the initiation and explosion of the train other than at the periphery of main charge 30.

The peripheral initiation of main charge 30 results in the mass focus effect, a phenomenon which is not as yet fully understood in the art. Nevertheless, the result is an energy enhancement at the center of the main charge 30. It is believed that the energy enhancement is caused by explosive wave motion inward, i.e., from the periphery toward the center of main charge 30.

The effect of detonation of main charge 30 plus the detonation of the lower peripheral explosive strip 29 insures detonation of explosive layer 31 between fragment plates 12 and 13. The detonation of explosive layer 31 provides additional energy coupling efficiency.

The two phenomena (i.e. mass focus, and energy coupling due to the layered explosive structure), in combination, then project the bomblet fragments at an increased maximum velocity and, thereby, increase the impact force and the lethality of the fragments.

Actual testing of a conventional fragmentation bomblet and of a fragmentation bomblet incorporating my invention resulted in a scatter or dispersion pattern as shown in FIG. 2. As can be seen by an inspection of FIG. 2, the fragments from the bomblet incorporating my invention attained increased maximum velocities of 8750 feet per second, as compared to the 6800 feet per second attained by the fragments of the conventional bomblet, and did so without any significant difference in angular deviation.

While there has been shown and described the fundamental features of my invention, as applied to a preferred embodiment, it is to be understood that this is by way of illustration and is not intended as a limitation.

Various substitutions and omissions may be made by those skilled in the art, without departing from the spirit of the invention. For example: obviously, the composition of the explosives may be varied; the buffer 28 may be altered to encompass other materials or, in special cases, may be omitted entirely; and aerodynamic or other devices may be added to the preferred embodiment, or variations thereof, to control orientation at the time of detonation.

What I claim is:

1. A fragmentation-type munition comprising:

a. a centrally located main explosive charge;

b. means for peripherally initiating said main explosive charge, wherein said means for peripherally initiating said main explosive charge includes:

1. a detonator;
2. and, a flexible sheet-type high explosive abutting said detonator and the periphery of said centrally located main explosive charge;

c. and, an outer case housing said main explosive charge and at least partially housing said means for peripherally initiating said main explosive charge, with said outer case having at least an internal portion thereof weakened to promote fragmentation thereof.

2. A fragmentation-type munition, as set forth in claim 1, wherein a buffer of inert foam plastic material is interposed between said flexible sheet-type high explosive and said centrally located main explosive charge.

3. A fragmentation-type munition, as set forth in claim 2, wherein said outer case is configurated as an open-ended right circular cylinder, with a plate abutting and closing one end and a plurality of plates abutting and closing the other end, with said plurality of plates having notches on the surface facing said centrally located main explosive charge and having a layer of high explosive between said plates, with said layer abutting a flexible sheet-type high explosive which abuts said centrally located main explosive charge.

* * * * *